US007946055B2

(12) United States Patent
Churchill et al.

(10) Patent No.: US 7,946,055 B2
(45) Date of Patent: May 24, 2011

(54) DRYER

(75) Inventors: John Churchill, Wiltshire (GB); James Dyson, Wiltshire (GB); Peter David Gammack, Wiltshire (GB)

(73) Assignee: Dyson Technology Limited, Malmesbury (GB)

( * ) Notice: Subject to any disclaimer, the term of this patent is extended or adjusted under 35 U.S.C. 154(b) by 265 days.

(21) Appl. No.: 11/997,301

(22) PCT Filed: Jun. 12, 2006

(86) PCT No.: PCT/GB2006/002138

§ 371 (c)(1),
(2), (4) Date: Jan. 29, 2008

(87) PCT Pub. No.: WO2007/015042

PCT Pub. Date: Feb. 8, 2007

(65) Prior Publication Data

US 2008/0216343 A1 Sep. 11, 2008

(30) Foreign Application Priority Data

Jul. 30, 2005 (GB) ..... 0515744.1
Jan. 17, 2006 (GB) ..... 0600881.7

(51) Int. Cl.
*F26B 19/00* (2006.01)

(52) U.S. Cl. ..... 34/80; 34/90; 34/104; 34/202; 34/210; 34/218; 34/224; 165/201; 4/623; 4/626; 68/3 R; 68/38; 2/16; 134/26; 134/57 R; 392/380; 392/381

(58) Field of Classification Search ..... 34/80, 90, 34/104, 202, 210, 218, 224; 165/201; 68/3 R, 68/38; 392/380, 381; 134/26, 57 R; 2/16; 4/626, 623

See application file for complete search history.

(56) References Cited

U.S. PATENT DOCUMENTS 16,110 A * 11/1856 Baldwin ..... 416/243
1,258,633 A * 3/1918 Heath ..... 219/468.1
1,500,094 A * 7/1924 Kee ..... 432/202
1,598,660 A * 9/1926 Sieben ..... 34/231
1,658,489 A * 2/1928 Lindstrom ..... 34/239

(Continued)

FOREIGN PATENT DOCUMENTS

CH 645277 A * 9/1984

(Continued)

OTHER PUBLICATIONS

GB Search Report dated Aug. 25, 2006, directed to counterpart Application No. GB0600881.7; 1 page.

(Continued)

*Primary Examiner* — Stephen M. Gravini
(74) *Attorney, Agent, or Firm* — Morrison & Foerster LLP

(57) ABSTRACT

A drying apparatus has a casing, a cavity formed in the casing for receiving an object, and a fan located in the casing and creating an airflow. At least one slot-like opening communicates with the fan and is arranged in the casing so as to direct an airflow transversely across the cavity. The slot-like opening is formed between opposing walls which are manufactured from a thermosetting plastics material. By manufacturing the walls of the slot-like opening from a thermosetting plastic material such as melamine, the walls of the slot-like opening can be molded economically instead of machined from metal. The thermosetting plastic material is dimensionally stable when moulded, thermally resistant and impact resistant.

13 Claims, 6 Drawing Sheets

U.S. PATENT DOCUMENTS

| | | | | | |
|---|---|---|---|---|---|
| 1,688,793 | A | * | 10/1928 | Schrenkeisen | 34/104 |
| 1,693,308 | A | * | 11/1928 | Merkowitz | 34/233 |
| 1,704,136 | A | | 3/1929 | Lemp | |
| 1,830,323 | A | * | 11/1931 | Judelson et al. | 34/87 |
| 2,109,028 | A | * | 2/1938 | Miller | 264/86 |
| 2,111,148 | A | * | 3/1938 | Judelson | 34/225 |
| 2,134,493 | A | * | 10/1938 | Uroukoff | 15/3.51 |
| 2,260,558 | A | * | 10/1941 | Caughey et al. | 86/1.1 |
| 2,267,158 | A | * | 12/1941 | Locke | 34/90 |
| 2,278,574 | A | * | 4/1942 | Spohr et al. | 426/421 |
| 2,385,962 | A | | 10/1945 | Barnett | |
| 2,645,032 | A | * | 7/1953 | Hammell | 34/562 |
| 3,009,188 | A | * | 11/1961 | Martin | 15/330 |
| 3,071,801 | A | * | 1/1963 | Scheiding | 452/173 |
| 3,096,702 | A | * | 7/1963 | Malone, Sr. et al. | 454/370 |
| 3,180,239 | A | * | 4/1965 | Beck, Jr. et al. | 399/33 |
| 3,437,030 | A | * | 4/1969 | Rosenthal et al. | 396/612 |
| 3,448,497 | A | * | 6/1969 | Schoeffler et al. | 425/515 |
| 3,464,388 | A | * | 9/1969 | Stout | 119/418 |
| 3,526,946 | A | * | 9/1970 | Palmer | 29/403.2 |
| 3,603,002 | A | * | 9/1971 | Spierer | 34/202 |
| 3,643,346 | A | * | 2/1972 | Lester | 34/202 |
| 3,667,134 | A | * | 6/1972 | Rockson | 34/60 |
| 3,670,718 | A | * | 6/1972 | Brendgord | 600/21 |
| 3,721,026 | A | * | 3/1973 | McCallum | 38/75 |
| 3,744,149 | A | | 7/1973 | Helbling | |
| 3,752,059 | A | * | 8/1973 | Boyer | 100/37 |
| 3,758,799 | A | * | 9/1973 | Dochterman et al. | 310/89 |
| 3,766,397 | A | | 10/1973 | Rockson | |
| 3,785,523 | A | * | 1/1974 | Goldstein | 221/42 |
| 3,797,752 | A | * | 3/1974 | Cercone | 239/443 |
| 3,874,073 | A | * | 4/1975 | Dochterman et al. | 29/598 |
| 3,952,867 | A | * | 4/1976 | McCord | 206/229 |
| 4,015,366 | A | * | 4/1977 | Hall, III | 47/1.43 |
| 4,047,692 | A | * | 9/1977 | Swin, Sr. | 249/142 |
| 4,085,522 | A | * | 4/1978 | Stroszynski | 34/640 |
| 4,087,925 | A | * | 5/1978 | Bienek | 34/60 |
| 4,107,257 | A | * | 8/1978 | Swin, Sr. | 264/275 |
| 4,144,596 | A | * | 3/1979 | MacFarlane et al. | 4/626 |
| 4,145,769 | A | * | 3/1979 | MacFarlane et al. | 4/626 |
| 4,205,460 | A | * | 6/1980 | Taylor | 34/225 |
| 4,220,846 | A | * | 9/1980 | Rice et al. | 392/488 |
| 4,267,643 | A | * | 5/1981 | Haried | 34/553 |
| 4,278,223 | A | * | 7/1981 | Fauteux | 248/125.8 |
| 4,295,233 | A | * | 10/1981 | Hinkel et al. | 4/619 |
| 4,310,747 | A | * | 1/1982 | Rice et al. | 392/466 |
| 4,313,787 | A | * | 2/1982 | Ciboit et al. | 159/48.1 |
| 4,334,350 | A | * | 6/1982 | Rice et al. | 29/611 |
| RE31,023 | E | * | 9/1982 | Hall, III | 405/37 |
| 4,383,377 | A | * | 5/1983 | Crafton | 34/60 |
| 4,398,310 | A | | 8/1983 | Lienhard | |
| 4,497,999 | A | * | 2/1985 | Postbeschild | 392/381 |
| 4,564,956 | A | * | 1/1986 | DiBuono | 2/16 |
| 4,600,128 | A | | 7/1986 | Rohrer | |
| 4,625,432 | A | * | 12/1986 | Baltes | 34/621 |
| 4,665,630 | A | * | 5/1987 | Postbeschild | 34/566 |
| 4,677,764 | A | * | 7/1987 | Cerny | 34/195 |
| 4,704,806 | A | | 11/1987 | Gresens | |
| 4,734,017 | A | * | 3/1988 | Levin | 417/366 |
| 4,802,287 | A | * | 2/1989 | Chen | 34/91 |
| 4,826,262 | A | * | 5/1989 | Hartman et al. | 312/34.12 |
| 4,843,653 | A | * | 7/1989 | Coble | 2/170 |
| 4,857,705 | A | | 8/1989 | Blevins | |
| 4,876,435 | A | * | 10/1989 | Hawkins | 392/381 |
| 4,914,833 | A | * | 4/1990 | Pilolla et al. | 34/526 |
| 4,941,521 | A | * | 7/1990 | Redekop et al. | 144/347 |
| 4,952,432 | A | * | 8/1990 | Ten Wolde | 428/41.8 |
| 4,986,681 | A | * | 1/1991 | Oliver | 401/7 |
| 4,993,172 | A | * | 2/1991 | Allen | 34/202 |
| 5,031,337 | A | * | 7/1991 | Pilolla et al. | 34/526 |
| 5,047,351 | A | | 9/1991 | Makiuchi et al. | |
| 5,064,154 | A | * | 11/1991 | Payne | 248/121 |
| 5,074,322 | A | * | 12/1991 | Jaw | 134/56 R |
| 5,107,603 | A | * | 4/1992 | Durazzani | 34/91 |
| 5,111,594 | A | * | 5/1992 | Allen | 34/266 |
| 5,146,695 | A | | 9/1992 | Yang | |
| 5,152,852 | A | | 10/1992 | Hisamichi et al. | |
| 5,168,621 | A | * | 12/1992 | Kruck et al. | 29/451 |
| 5,186,360 | A | * | 2/1993 | Mease et al. | 222/63 |
| 5,249,370 | A | * | 10/1993 | Stanger et al. | 34/443 |
| 5,253,373 | A | * | 10/1993 | Tsipov | 4/343 |
| 5,280,679 | A | * | 1/1994 | Edelman | 34/66 |
| 5,374,118 | A | * | 12/1994 | Kruck et al. | 312/407 |
| 5,377,427 | A | * | 1/1995 | Mashata | 34/275 |
| 5,379,483 | A | * | 1/1995 | Pino | 15/323 |
| 5,379,525 | A | * | 1/1995 | Raynor | 34/104 |
| 5,397,028 | A | * | 3/1995 | Jesadanont | 222/1 |
| 5,407,354 | A | * | 4/1995 | Fife | 433/116 |
| 5,407,723 | A | * | 4/1995 | Curtin | 428/124 |
| 5,436,092 | A | | 7/1995 | Ohtsuka et al. | |
| 5,459,944 | A | | 10/1995 | Tatsutani et al. | |
| 5,522,411 | A | * | 6/1996 | Johnson | 134/95.2 |
| 5,545,451 | A | * | 8/1996 | Haung et al. | 428/36.8 |
| 5,546,678 | A | * | 8/1996 | Dhaemers | 34/275 |
| 5,555,640 | A | * | 9/1996 | Ou | 34/202 |
| 5,601,870 | A | * | 2/1997 | Haung et al. | 427/133 |
| 5,612,083 | A | * | 3/1997 | Haung et al. | 264/233 |
| 5,636,815 | A | * | 6/1997 | Wilson | 248/125.9 |
| 5,755,040 | A | * | 5/1998 | Ou | 34/202 |
| 5,870,836 | A | * | 2/1999 | Grimes | 34/202 |
| 5,873,178 | A | | 2/1999 | Johnson | |
| 5,882,743 | A | * | 3/1999 | McConnell | 428/12 |
| 5,945,068 | A | * | 8/1999 | Ferone | 422/28 |
| 5,972,474 | A | | 10/1999 | Tsuzuki et al. | |
| 5,974,685 | A | * | 11/1999 | Hironaka | 34/202 |
| 5,987,773 | A | * | 11/1999 | Lipscy | 34/106 |
| 6,005,227 | A | * | 12/1999 | Pappas | 219/400 |
| 6,038,786 | A | | 3/2000 | Aisenberg et al. | |
| 6,047,485 | A | * | 4/2000 | Madyun | 34/202 |
| 6,050,000 | A | * | 4/2000 | Curzon | 34/572 |
| 6,050,275 | A | * | 4/2000 | Kamikawa et al. | 134/105 |
| 6,085,442 | A | * | 7/2000 | Erickson | 34/381 |
| 6,104,302 | A | * | 8/2000 | Vuong | 340/635 |
| 6,119,361 | A | * | 9/2000 | Baker | 34/95.2 |
| 6,119,437 | A | * | 9/2000 | Baker | 53/425 |
| 6,131,588 | A | * | 10/2000 | Kamikawa et al. | 134/102.3 |
| 6,137,067 | A | * | 10/2000 | Helms et al. | 200/38 R |
| 6,158,673 | A | * | 12/2000 | Toetschinger et al. | 239/305 |
| 6,185,838 | B1 | | 2/2001 | Moore | |
| 6,206,980 | B1 | * | 3/2001 | Robinson | 134/21 |
| 6,263,591 | B1 | * | 7/2001 | La Porte | 34/622 |
| 6,279,836 | B1 | * | 8/2001 | Toetschinger et al. | 239/70 |
| 6,280,092 | B1 | * | 8/2001 | Backus et al. | 384/425 |
| 6,295,410 | B1 | * | 9/2001 | Helms et al. | 392/381 |
| 6,298,777 | B1 | * | 10/2001 | Dubois et al. | 101/27 |
| 6,342,104 | B1 | * | 1/2002 | Kamikawa et al. | 134/26 |
| 6,431,189 | B1 | * | 8/2002 | Deibert | 134/57 R |
| 6,431,217 | B2 | * | 8/2002 | Robinson | 138/110 |
| 6,606,801 | B2 | * | 8/2003 | Strang et al. | 34/437 |
| 6,620,504 | B2 | * | 9/2003 | Mizumura et al. | 428/357 |
| 6,684,648 | B2 | * | 2/2004 | Faqih | 62/93 |
| 6,705,107 | B2 | * | 3/2004 | Schlosser et al. | 62/344 |
| 6,732,858 | B1 | * | 5/2004 | Chang Ou | 206/278 |
| 6,746,543 | B2 | * | 6/2004 | Kamikawa et al. | 134/26 |
| 6,749,148 | B2 | * | 6/2004 | Helfer-Grand | 242/564.1 |
| 6,766,589 | B1 | * | 7/2004 | Bory et al. | 34/90 |
| 6,769,197 | B1 | * | 8/2004 | Tai | 34/90 |
| 6,793,851 | B1 | * | 9/2004 | Bompay et al. | 264/31 |
| 6,845,569 | B1 | * | 1/2005 | Kim | 34/106 |
| 6,860,032 | B2 | * | 3/2005 | Meyer | 34/225 |
| 6,956,498 | B1 | * | 10/2005 | Gauthier et al. | 340/825.69 |
| 6,962,235 | B2 | | 11/2005 | Leon | |
| 6,973,740 | B2 | * | 12/2005 | Meyer | 34/224 |
| 7,036,242 | B2 | | 5/2006 | Komulainen et al. | |
| 7,036,575 | B1 | * | 5/2006 | Rodney et al. | 165/201 |
| 7,039,301 | B1 | | 5/2006 | Aisenberg et al. | |
| 7,040,021 | B2 | * | 5/2006 | Talavera | 30/133 |
| 7,087,117 | B2 | * | 8/2006 | Katsuoka et al. | 118/429 |
| 7,150,890 | B2 | * | 12/2006 | Rosales et al. | 424/778 |
| 7,284,391 | B2 | * | 10/2007 | Miller et al. | 62/347 |
| 7,309,376 | B2 | * | 12/2007 | Barre et al. | 95/10 |
| 7,437,833 | B2 | | 10/2008 | Sato et al. | |
| 7,442,257 | B2 | * | 10/2008 | Katsuoka et al. | 118/500 |
| 7,509,998 | B1 | * | 3/2009 | Rodney | 165/201 |
| 7,526,833 | B2 | * | 5/2009 | Cochran et al. | 15/327.2 |
| 7,555,209 | B2 | * | 6/2009 | Pradas Diez et al. | 392/380 |
| 7,562,543 | B2 | * | 7/2009 | Kendall et al. | 68/13 R |

| | | | | |
|---|---|---|---|---|
| 7,575,636 | B2 * | 8/2009 | Katsuoka et al. | 118/428 |
| 7,587,917 | B2 * | 9/2009 | Gilboe et al. | 68/240 |
| 7,596,883 | B2 * | 10/2009 | Kameishi | 34/90 |
| 7,597,122 | B1 * | 10/2009 | Smith | 141/114 |
| 7,614,160 | B2 * | 11/2009 | Kameishi et al. | 34/90 |
| 7,617,702 | B2 * | 11/2009 | Sunshine et al. | 68/3 R |
| 7,624,600 | B2 * | 12/2009 | Sunshine et al. | 68/3 R |
| 7,628,043 | B2 * | 12/2009 | Sunshine et al. | 68/38 |
| 7,653,963 | B2 * | 2/2010 | Cochran et al. | 15/323 |
| 7,802,340 | B2 * | 9/2010 | Knopow et al. | 15/144.1 |
| 7,832,697 | B2 * | 11/2010 | West et al. | 248/276.1 |
| 7,856,736 | B2 * | 12/2010 | Churchill et al. | 34/90 |
| 2001/0000576 | A1 * | 5/2001 | Robinson | 134/169 C |
| 2001/0027795 | A1 * | 10/2001 | Cain-Kozma et al. | 132/73 |
| 2002/0046569 | A1 * | 4/2002 | Faqih | 62/188 |
| 2002/0078705 | A1 * | 6/2002 | Schlosser et al. | 62/352 |
| 2002/0132214 | A1 * | 9/2002 | Mattson et al. | 434/323 |
| 2002/0198662 | A1 * | 12/2002 | Chen | 702/19 |
| 2003/0000036 | A1 * | 1/2003 | Fan | 15/120.1 |
| 2003/0066281 | A1 * | 4/2003 | Mizumura et al. | 57/248 |
| 2003/0071075 | A1 * | 4/2003 | Frankenbach et al. | 222/383.1 |
| 2003/0074718 | A1 * | 4/2003 | English | 2/239 |
| 2003/0159718 | A1 * | 8/2003 | Kamikawa et al. | 134/30 |
| 2004/0031119 | A1 * | 2/2004 | McKay | 15/227 |
| 2004/0045168 | A1 * | 3/2004 | Talavera | 30/133 |
| 2004/0049940 | A1 | 3/2004 | Komulainen et al. | |
| 2004/0088817 | A1 * | 5/2004 | Cochran et al. | 15/327.5 |
| 2004/0090040 | A1 * | 5/2004 | Pearson | 280/288.4 |
| 2004/0108281 | A1 * | 6/2004 | Gerteis et al. | 210/781 |
| 2004/0226312 | A1 * | 11/2004 | Miller et al. | 62/353 |
| 2004/0244090 | A1 * | 12/2004 | Langer | 2/160 |
| 2005/0072358 | A1 * | 4/2005 | Katsuoka et al. | 118/719 |
| 2005/0076529 | A1 * | 4/2005 | Holmes | 34/90 |
| 2005/0100436 | A1 * | 5/2005 | Egusquiza | 415/1 |
| 2005/0120508 | A1 * | 6/2005 | Morgan et al. | 15/320 |
| 2005/0153002 | A1 * | 7/2005 | Socla Rosales et al. | 424/764 |
| 2005/0211357 | A1 * | 9/2005 | Ren | 152/450 |
| 2005/0258114 | A1 * | 11/2005 | Davis | 211/70.6 |
| 2005/0273969 | A1 * | 12/2005 | Watson et al. | 15/344 |
| 2006/0000110 | A1 | 1/2006 | Aisenberg et al. | |
| 2006/0036198 | A1 * | 2/2006 | Cafaro et al. | 601/16 |
| 2006/0060082 | A1 * | 3/2006 | Barre et al. | 95/117 |
| 2006/0171660 | A1 * | 8/2006 | Hsu | 386/46 |
| 2006/0180596 | A1 * | 8/2006 | Young et al. | 221/63 |
| 2006/0191901 | A1 * | 8/2006 | Taylor et al. | 219/521 |
| 2006/0201015 | A1 * | 9/2006 | Russell | 34/90 |
| 2006/0236929 | A1 * | 10/2006 | Katsuoka et al. | 118/412 |
| 2006/0243204 | A1 * | 11/2006 | Katsuoka et al. | 118/423 |
| 2006/0243205 | A1 * | 11/2006 | Katsuoka et al. | 118/423 |
| 2006/0272170 | A1 * | 12/2006 | Holmes | 34/275 |
| 2006/0288508 | A1 * | 12/2006 | Knopow et al. | 15/144.1 |
| 2007/0079524 | A1 * | 4/2007 | Sato et al. | 34/202 |
| 2007/0094884 | A1 | 5/2007 | Micheludis | |
| 2007/0113369 | A1 * | 5/2007 | Cochran et al. | 15/327.5 |
| 2007/0144034 | A1 | 6/2007 | Kameishi | |
| 2007/0160515 | A1 * | 7/2007 | Mohrman | 422/300 |
| 2007/0163141 | A1 * | 7/2007 | Hsu | 34/282 |
| 2007/0263994 | A1 * | 11/2007 | Diez et al. | 392/380 |
| 2007/0290110 | A1 * | 12/2007 | West et al. | 248/314 |
| 2008/0004963 | A1 * | 1/2008 | Montalbano et al. | 705/14 |
| 2008/0052952 | A1 * | 3/2008 | Nelson | 34/554 |
| 2008/0127830 | A1 * | 6/2008 | Le et al. | 96/154 |
| 2008/0209760 | A1 * | 9/2008 | French et al. | 34/585 |
| 2008/0216342 | A1 | 9/2008 | Kameishi et al. | |
| 2008/0216343 | A1 * | 9/2008 | Churchill et al. | 34/202 |
| 2008/0216344 | A1 * | 9/2008 | Churchill et al. | 34/202 |
| 2008/0222910 | A1 * | 9/2008 | Churchill et al. | 34/202 |
| 2008/0253754 | A1 * | 10/2008 | Rubin | 392/381 |
| 2008/0256825 | A1 * | 10/2008 | Hsu | 34/529 |
| 2008/0259566 | A1 * | 10/2008 | Fried | 361/699 |
| 2008/0263889 | A1 * | 10/2008 | Fukaya et al. | 34/267 |
| 2008/0272734 | A1 * | 11/2008 | Ren | 320/109 |
| 2008/0301970 | A1 * | 12/2008 | Hackwell et al. | 34/202 |
| 2008/0313918 | A1 * | 12/2008 | Dyson et al. | 34/202 |
| 2008/0313919 | A1 | 12/2008 | Churchill et al. | |
| 2008/0317448 | A1 | 12/2008 | Brown et al. | |
| 2009/0000142 | A1 | 1/2009 | Churchill et al. | |
| 2009/0004962 | A1 * | 1/2009 | Collins | 454/252 |
| 2009/0034946 | A1 * | 2/2009 | Caine et al. | 392/380 |
| 2009/0044420 | A1 * | 2/2009 | Hsu | 34/88 |
| 2009/0077736 | A1 * | 3/2009 | Loberger et al. | 4/623 |
| 2009/0113746 | A1 * | 5/2009 | Churchill et al. | 34/202 |
| 2009/0113748 | A1 * | 5/2009 | Dyson et al. | 34/232 |
| 2009/0119942 | A1 | 5/2009 | Aisenberg et al. | |
| 2009/0195877 | A1 | 8/2009 | Nakai | |
| 2009/0236629 | A1 | 9/2009 | Nishikawa et al. | |
| 2009/0293304 | A1 * | 12/2009 | Yang | 34/547 |
| 2009/0320316 | A1 * | 12/2009 | Zakai | 34/275 |
| 2010/0005614 | A1 * | 1/2010 | Cochran et al. | 15/327.5 |
| 2010/0052408 | A1 * | 3/2010 | Ren | 301/5.1 |
| 2010/0119755 | A1 | 5/2010 | Chung et al. | |
| 2010/0130686 | A1 | 5/2010 | Oshima | |
| 2010/0154239 | A1 * | 6/2010 | Hutchinson | 34/82 |
| 2010/0192399 | A1 * | 8/2010 | Sawabe et al. | 34/95 |
| 2010/0209080 | A1 * | 8/2010 | Rubin et al. | 392/380 |
| 2010/0210745 | A1 * | 8/2010 | Mcdaniel et al. | 521/55 |
| 2010/0227963 | A1 * | 9/2010 | Hironaka et al. | 524/451 |

FOREIGN PATENT DOCUMENTS

| | | | | |
|---|---|---|---|---|
| CH | 645277 | A5 * | 9/1984 | |
| CH | 669116 | A * | 2/1989 | |
| CH | 669116 | A5 * | 2/1989 | |
| DE | 548 998 | | 4/1932 | |
| DE | 26 57 164 | | 6/1978 | |
| DE | 3116285 | A1 * | 2/1983 | |
| DE | 3204258 | A1 * | 8/1983 | |
| DE | 3218578 | A1 * | 11/1983 | |
| DE | 3440412 | A1 * | 3/1986 | |
| DE | 3530888 | A1 * | 3/1986 | |
| DE | 3443438 | A1 * | 5/1986 | |
| DE | 3443439 | A1 * | 5/1986 | |
| DE | 3513159 | A1 * | 10/1986 | |
| DE | 3527835 | A1 * | 2/1987 | |
| DE | 3529410 | A1 * | 2/1987 | |
| DE | 3735197 | A1 * | 5/1989 | |
| DE | 3814489 | A1 * | 11/1989 | |
| DE | 4022003 | A1 * | 1/1992 | |
| DE | 4107439 | A1 * | 9/1992 | |
| DE | 4107489 | A1 * | 9/1992 | |
| DE | 4218658 | A1 * | 12/1992 | |
| DE | 4208680 | A1 * | 9/1993 | |
| DE | 4428978 | A1 * | 3/1995 | |
| DE | 19654756 | A1 * | 7/1998 | |
| DE | 10109237 | A1 * | 9/2002 | |
| DE | 101 14 473 | | 10/2002 | |
| DE | 10147778 | A1 * | 4/2003 | |
| DE | 10157975 | A1 * | 6/2003 | |
| EP | 59888 | A1 * | 9/1982 | |
| EP | 68491 | A2 * | 1/1983 | |
| EP | 251898 | A1 * | 1/1988 | |
| EP | 329171 | A1 * | 8/1989 | |
| EP | 0 357 305 | | 3/1990 | |
| EP | 357305 | A1 * | 3/1990 | |
| EP | 382521 | A1 * | 8/1990 | |
| EP | 393254 | A1 * | 10/1990 | |
| EP | 567678 | A1 * | 11/1993 | |
| EP | 574160 | A1 * | 12/1993 | |
| EP | 0 589 568 | | 3/1994 | |
| EP | 644334 | A1 * | 3/1995 | |
| EP | 679358 | A2 * | 11/1995 | |
| EP | 832697 | A2 * | 4/1998 | |
| EP | 855736 | A2 * | 7/1998 | |
| EP | 976356 | A2 * | 2/2000 | |
| EP | 1166704 | A1 * | 1/2002 | |
| EP | 1250878 | A2 * | 10/2002 | |
| EP | 1250879 | A2 * | 10/2002 | |
| FR | 2537425 | A1 * | 6/1984 | |
| FR | 2543592 | A1 * | 10/1984 | |
| FR | 2569029 | A1 * | 2/1986 | |
| FR | 2577109 | A1 * | 8/1986 | |
| FR | 2582196 | A1 * | 11/1986 | |
| FR | 2588741 | A1 * | 4/1987 | |
| FR | 2595455 | A1 * | 9/1987 | |
| FR | 2597717 | A1 * | 10/1987 | |
| FR | 2790979 | A1 * | 9/2000 | |
| GB | 680148 | | 10/1952 | |
| GB | 2012362 | A * | 7/1979 | |
| GB | 2050609 | A * | 1/1981 | |

| | | | | |
|---|---|---|---|---|
| GB | 2054151 | A | * | 2/1981 |
| GB | 2057528 | A | * | 4/1981 |
| GB | 2085725 | A | * | 5/1982 |
| GB | 2112639 | A | * | 7/1983 |
| GB | 2116034 | A | * | 9/1983 |
| GB | 2136291 | A | * | 9/1984 |
| GB | 2137878 | A | * | 10/1984 |
| GB | 2142128 | A | * | 1/1985 |
| GB | 2144325 | A | * | 3/1985 |
| GB | 2147804 | A | * | 5/1985 |
| GB | 2179856 | A | * | 3/1987 |
| GB | 2189382 | A | * | 10/1987 |
| GB | 2196843 | A | * | 5/1988 |
| GB | 2198229 | A | * | 6/1988 |
| GB | 2236248 | A | * | 4/1991 |
| GB | 2 249 026 | A | | 4/1992 |
| GB | 2 253 035 | | | 8/1992 |
| GB | 2 434 094 | | | 7/2007 |
| JP | 61-21393 | U | | 2/1986 |
| JP | 63-154138 | A | | 6/1988 |
| JP | 3-82419 | A | | 4/1991 |
| JP | 3-82420 | A | | 4/1991 |
| JP | 4-73026 | A | | 3/1992 |
| JP | 06-62979 | | | 3/1994 |
| JP | 7-79880 | | | 3/1995 |
| JP | 07-116076 | | | 5/1995 |
| JP | 7-308266 | | | 11/1995 |
| JP | 8-187209 | | | 7/1996 |
| JP | 09-135789 | | | 5/1997 |
| JP | 10-113304 | | | 5/1998 |
| JP | 10-248748 | | | 9/1998 |
| JP | 11-70058 | | | 3/1999 |
| JP | 11-244191 | | | 9/1999 |
| JP | 2000-245653 | | | 9/2000 |
| JP | 2001-157647 | | | 6/2001 |
| JP | 2001-346715 | | | 12/2001 |
| JP | 2002-34835 | | | 2/2002 |
| JP | 2002-034845 | | | 2/2002 |
| JP | 2002-34852 | | | 2/2002 |
| JP | 2002-136448 | | | 5/2002 |
| JP | 2002-306370 | | | 10/2002 |
| JP | 2003-180554 | | | 7/2003 |
| JP | 2004-105511 | | | 4/2004 |
| JP | 2004-113615 | | | 4/2004 |
| JP | 2004-113712 | | | 4/2004 |
| JP | 2004-231935 | | | 8/2004 |
| JP | 2004-305287 | | | 11/2004 |
| JP | 2004-357820 | | | 12/2004 |
| JP | 2005-168799 | | | 6/2005 |
| JP | 2006-187397 | | | 7/2006 |
| WO | WO 8503462 | A1 | * | 8/1985 |
| WO | WO 8504184 | A1 | * | 9/1985 |
| WO | WO 8606693 | A1 | * | 11/1986 |
| WO | WO 8707040 | A1 | * | 11/1987 |
| WO | WO 97/34708 | | | 9/1997 |
| WO | WO 9826703 | A1 | * | 6/1998 |
| WO | WO 9853752 | A2 | * | 12/1998 |
| WO | WO 9953250 | A1 | * | 10/1999 |
| WO | WO 03024291 | A1 | * | 3/2003 |
| WO | WO 2004100743 | A1 | * | 11/2004 |
| WO | WO 2005/029687 | | | 3/2005 |
| WO | WO 2007/015040 | | | 2/2007 |
| WO | WO 2007/015045 | | | 2/2007 |

OTHER PUBLICATIONS

GB Search Report dated Oct. 28, 2005, directed to counterpart Application No. GB0515744.1; 1 page.

International Search Report mailed Jul. 8, 2006, directed to counterpart Application No. PCT/GB2006/002138; 1 page.

GB Search Report mailed Mar. 27, 2006, directed at counterpart GB application No. 0600534.2; 1 page.

International Search Report mailed Mar. 16, 2007, directed at counterpart international application No. PCT/GB2007/000089; 4 pages.

International Search Report and written Opinion of the International Searching Authority dated Aug. 25, 2006, directed to counterpart application No. PCT/GB2006/002084; 14 pages.

GB Search Report dated Nov. 18, 2005, directed to counterpart GB Application No. GB0515754.0; 1 page.

Churchill et al., U.S. Office Action mailed Aug. 17, 2010, directed to U.S. Appl. No. 11/997,303; 7 pages.

GB Search Report dated Oct. 27, 2005, directed to GB application No. GB0515752.4.

GB Search Report dated Nov. 24, 2005, directed to GB application No. GB0515752.4.

International Search Report dated Jul. 17, 2006, directed to PCT application No. PCT/GB2006/002139.

GB Search Report dated Oct. 27, 2005, directed to GB application No. GB0515749.0; 1 page.

International Search Report dated Aug. 25, 2006, directed to PCT application No. PCT/GB2006/002199; 2 pages.

Churchill et al., U.S. Office Action mailed Apr. 1, 2010, directed to U.S. Appl. No. 11/997,303; 9 pages.

* cited by examiner

DRYER

REFERENCE TO RELATED APPLICATIONS

This application is a national stage application under 35 USC 371 of International Application No. PCT/GB2006/002138, filed Jun. 12, 2006, which claims the priority of United Kingdom Application Nos. 0515744.1, filed Jul. 30, 2005, and 0600881.7, filed Jan. 17, 2006, the contents of which prior applications are incorporated herein by reference.

FIELD OF THE INVENTION

The invention relates to a dryer which makes use of narrow streams of high velocity, high pressure air to dry a user's hands.

BACKGROUND OF THE INVENTION

The use of air jets to dry hands is well known. Examples of hand dryers which have at least one slot-like opening emitting at least one air jet for the purposes of drying hands are shown in GB 2249026A, JP 2002 034835A and JP 2002306370A. However, the efficient operation of such drying apparatus depends of the provision of slot-like openings which have a constant width along the length of the opening. The cost-effective manufacture of such openings presents certain difficulties, particularly when the airflow emitted through the openings is at a relatively high temperature. Commonly, the slot-like openings of the prior art apparatus have been manufactured from metal (such as stainless steel or aluminium) which increases the weight cost of the product.

SUMMARY OF THE INVENTION

It is an object of the invention to provide drying apparatus which, in use, dries an object efficiently and is more economical to manufacture than the prior art devices. It is another object to provide an improved hand dryer in which the manufacturing costs are reduced in comparison to the prior art.

The invention provides drying apparatus having a casing, a cavity formed in the casing for receiving an object, a fan located in the casing and capable of creating an airflow, and at least one slot-like opening communicating with the fan and arranged in the casing so as to direct an airflow transversely across the cavity, wherein the slot-like opening is formed between walls which are manufactured from a thermosetting plastics material.

By manufacturing the walls of the slot-like opening from a thermosetting plastics material such as melamine, the walls of the slot-like opening can be moulded economically instead of machined from metal. The thermosetting plastics material is dimensionally stable when moulded, thermally resistant and impact resistant.

Preferably, the maximum width of the slot is no more than 0.5 mm, more preferably between 0.3 mm and 0.4 mm. In a preferred embodiment, the slot-like opening has a constant width along its length.

It is preferred that at least one upstanding member is provided between the opposing walls of the slot-like opening. The or each upstanding member is preferably shaped so as to minimise the introduction of turbulence to an airstream emitted through the slot-like opening when the drying apparatus is in use.

BRIEF DESCRIPTION OF THE DRAWINGS

An embodiment of the invention will now be described with reference to the accompanying drawings, in which.

DETAILED DESCRIPTION OF THE INVENTION

Figure 2:
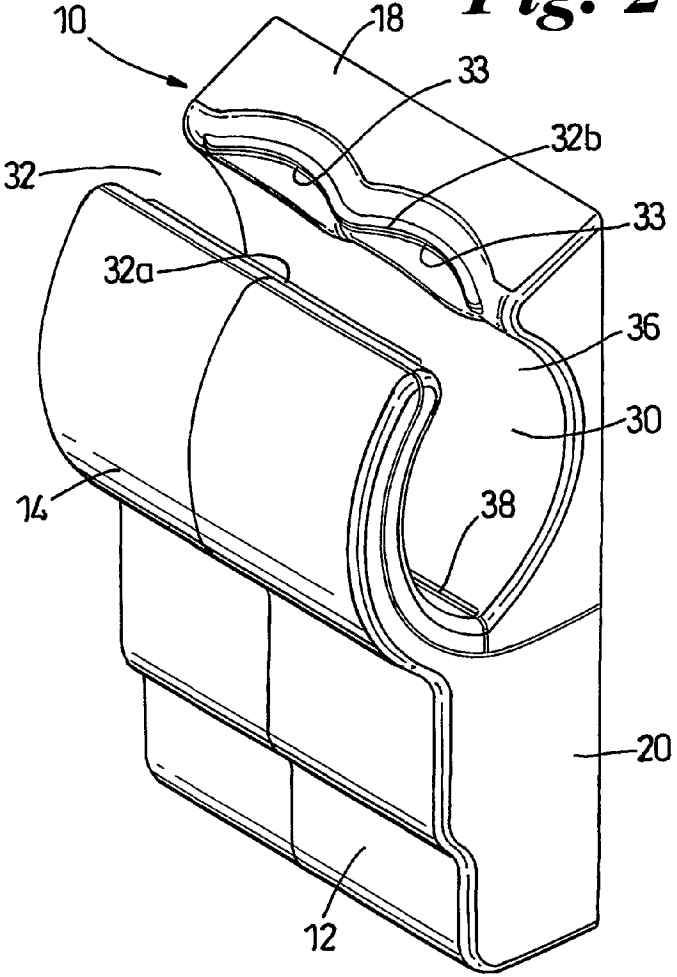
FIG. 2 is a perspective view of the hand dryer of FIG. 1.
Figure 1:
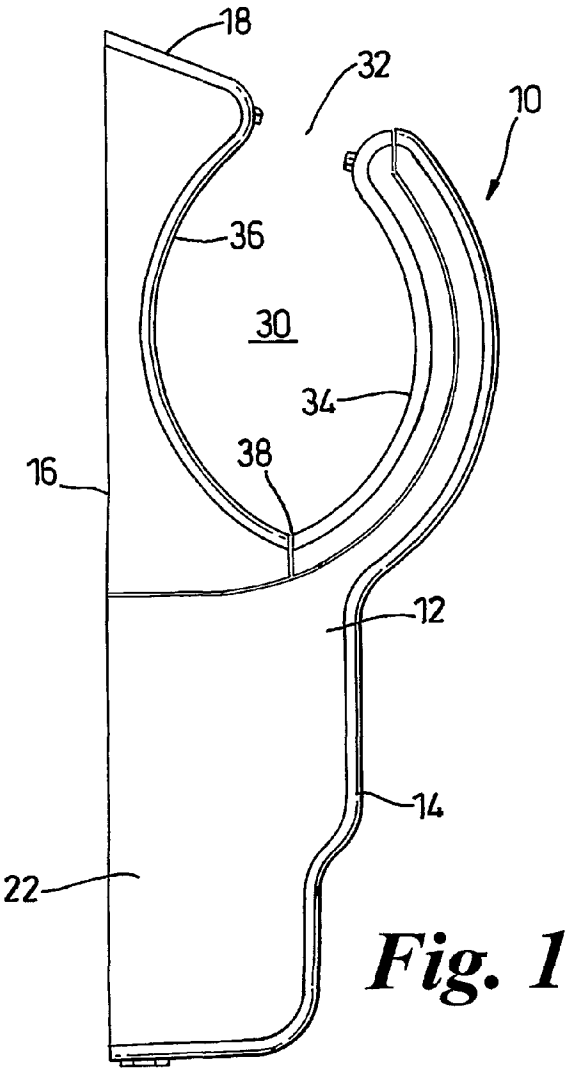
FIG. 1 is a side view of drying apparatus according to the invention in the form of a hand dryer.

Referring firstly to FIGS. 1 and 2, the hand dryer 10 shown in the drawings comprises an outer casing 12 having a front wall 14, a rear wall 16, an upper face 18 and side walls 20, 22. The rear wall 16 can incorporate fixing devices (not shown) for securing the hand dryer 10 to a wall or other structure prior to use. An electrical connection (not shown) is also provided on the rear wall or elsewhere on the casing 12. A cavity 30 is formed in the upper part of the casing 12 as can be seen from FIGS. 1 and 2. The cavity 30 is open at its upper end and delimited thereat by the top of the front wall 14 and the front of the upper face 18. The space between the top of the front wall 14 and the front of the upper face 18 forms a cavity entrance 32 which is sufficiently wide to allow a user's hands to be introduced to the cavity 30 through the cavity entrance 32. The cavity 30 is also open to the sides of the hand dryer 10 by appropriate shaping of the side walls 20, 22.

The cavity 30 has a front wall 34 and a rear wall 36 which delimit the cavity 30 to the front and rear respectively. Located in the lowermost end of the cavity 30 is a drain 38 which communicates with a reservoir (not shown) located in the lower part of the casing 12. The purpose of the drain and reservoir will be described below.

Figure 3:
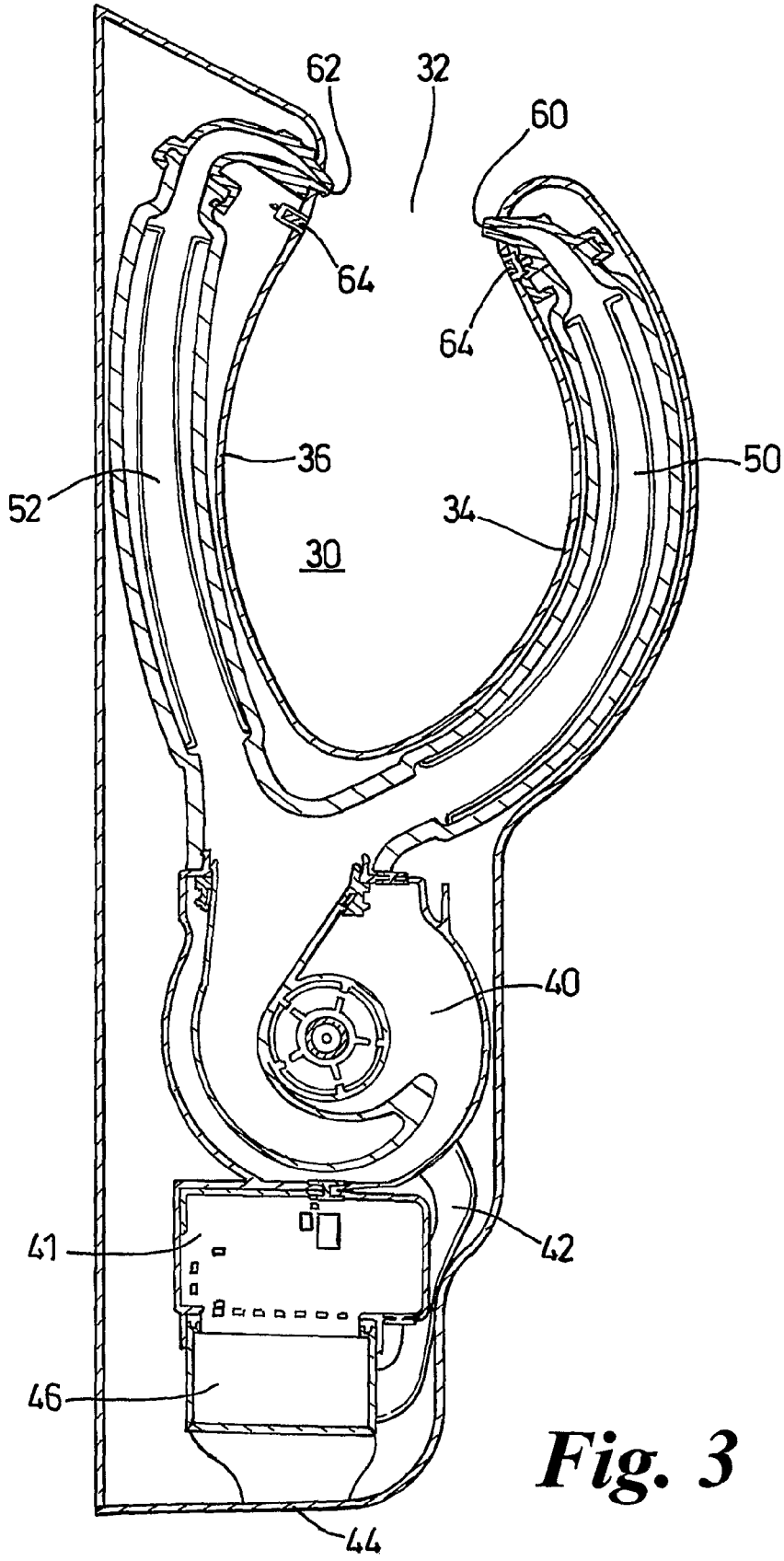
FIG. 3 is a side sectional view of the hand dryer of FIG. 1.

As shown in FIG. 3, a motor (not shown) is located inside the casing 12 and a fan 40, which is driven by the motor, is also located inside the casing 12. The motor is connected to the electrical connection and is controlled by a controller 41. The inlet 42 of the fan 40 communicates with an air inlet 44 formed in the casing 12. A filter 46 is located in the air passageway connecting the air inlet 44 to the fan inlet 42 so as to prevent the ingress of any debris which might cause damage to the motor or the fan 40. The outlet of the fan 40 communicates with a pair of air ducts 50, 52 which are located inside the casing 12. The front air duct 50 is located primarily between the front wall 14 of the casing 12 and the front wall 34 of the cavity 30, and the rear air duct 52 is located primarily between the rear wall 16 of the casing 12 and the rear wall 36 of the cavity 30.

The air ducts 50, 52 are arranged to conduct air from the fan 40 to a pair of opposed slot-like openings 60, 62 which are located in the front and rear walls 34, 36 respectively of the cavity 30. The slot-like openings 60, 62 are arranged at the upper end of the cavity 30 in the vicinity of the cavity entrance 32. The slot-like openings 60, 62 are each configured so as to direct an airflow generally across the cavity entrance 32 towards the opposite wall of the cavity 30. The slot-like openings 60, 62 are offset in the vertical direction and angled towards the base of the cavity 30.

Figure 4:
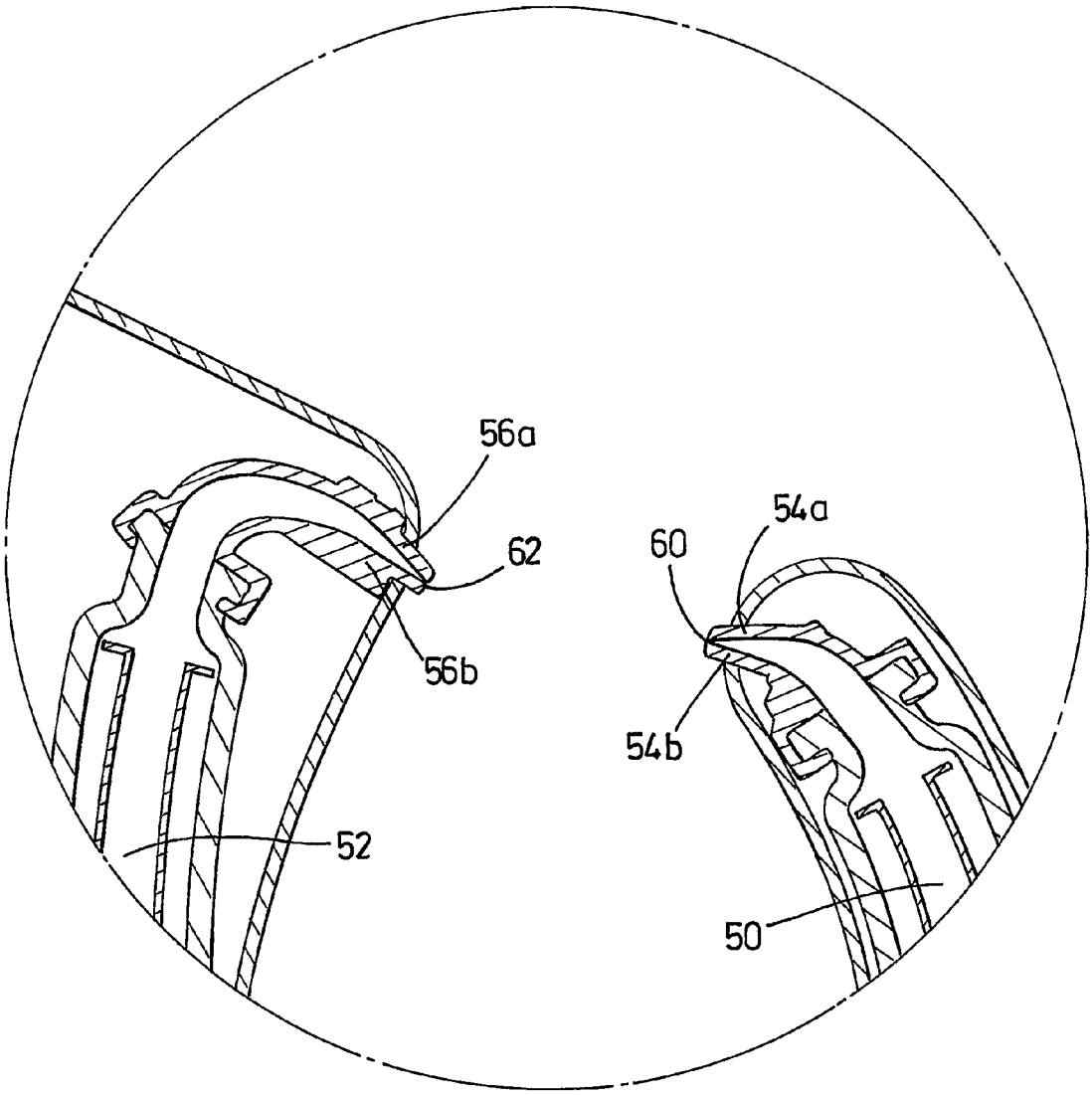
FIG. 4 is a side sectional view, shown on an enlarged scale, of the upper ends of the air ducts forming part of the hand dryer of FIG. 1.
Figure 5:
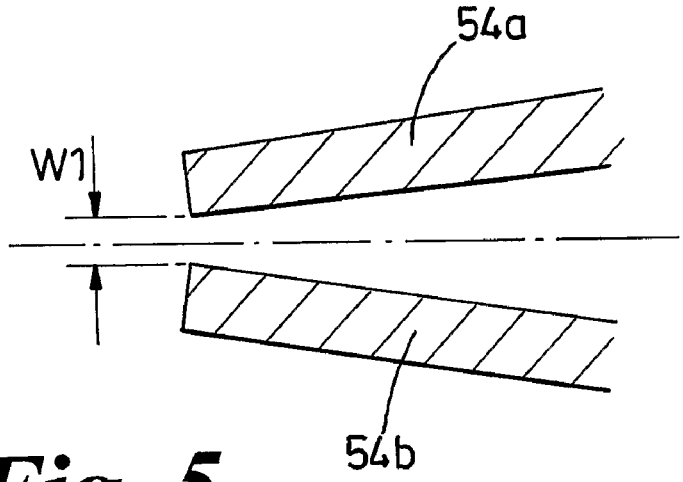
FIG. 5 is a schematic sectional side view, shown on a further enlarged scale, of the slot-like opening located in the front wall of the cavity of the hand dryer of FIG. 1.
Figure 6:
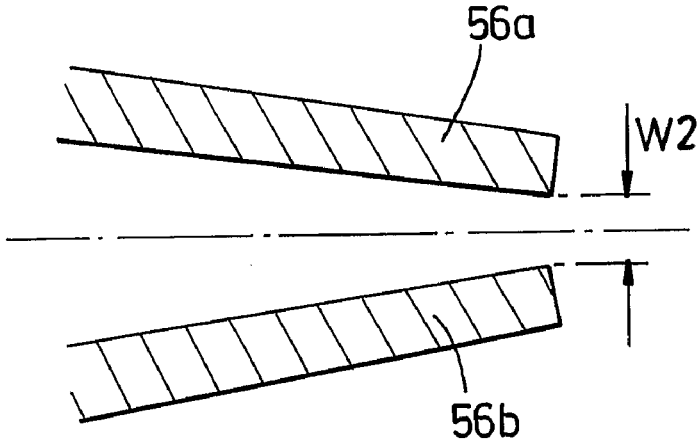
FIG. 6 is a schematic sectional side view, shown on the same further enlarged scale, of the slot-like opening located in the rear wall of the cavity of the hand dryer of FIG. 1.

FIG. 4 shows the upper ends of the air ducts 50, 52 and the slot-like openings 60, 62 in greater detail. As can be seen, the walls 54*a*, 54*b* of the air duct 50 converge to form the slot-like opening 60 and the walls 56*a*, 56*b* of the air duct 52 converge to form the slot-like opening 62. Even greater detail can be seen in FIGS. 5 and 6. FIG. 5 shows that the slot-like opening 60 has a width of W1 and FIG. 6 shows that the slot-like opening 62 has a width of W2. The width W1 of the slot-like opening 60 is smaller than the width W2 of the slot-like opening 62. The width W1 is 0.3 mm and the width W2 is 0.4 mm.

The walls 54*a*, 54*b*, 56*a*, 56*b* of the slot-like openings 60, 62 are moulded from a thermosetting plastics material, or thermosetting resin. These materials are dimensionally stable when subjected to the moulding process and are also thermally resistant at the required temperatures. The fact that the airflow exiting from the slot-like openings 60, 62 is only warmed by its passage past the motor means that the walls 54*a*, 54*b*, 56*a*, 56*b* are unlikely to be affected by the temperature of the airflow during normal use of the hand dryer. The thermosetting plastics materials are also impact resistant, which means that the walls 54*a*, 54*b*, 56*a*, 56*b* are able to withstand any impacts resulting from normal use of the hand dryer.

The walls 54*a*, 54*b*, 56*a*, 56*b* are formed by compression moulding. In the embodiment shown, the material used to form the walls 54*a*, 54*b*, 56*a*, 56*b* is melamine, although other materials such as urea-formaldehyde and phenolic resin could also be used. The material of the walls 54*a*, 54*b*, 56*a*, 56*b* also has antibacterial properties, in the form of either an antibacterial ingredient or a coating of an antibacterial substance.

Sensors 64 are positioned in the front and rear walls 34, 36 of the cavity 30 immediately below the slot-like openings 60, 62. These sensors 64 detect the presence of a user's hands which are inserted into the cavity 30 via the cavity entrance 32 and are arranged to send a signal to the motor when a user's hands are introduced to the cavity 30. As can be seen from FIGS. 1 and 3, the walls 54*a*, 54*b*, 56*a*, 56*b* of the ducts 50, 52 project slightly beyond the surface of the front and rear walls 34, 36 of the cavity 30. The inward projection of the walls 54*a*, 54*b*, 56*a*, 56*b* of the ducts 50, 52 reduces the tendency of the user's hands to be sucked towards one or other of the walls 34, 36 of the cavity, which enhances the ease with which the hand dryer 10 can be used. The positioning of the sensors 64 immediately below the inwardly projecting walls 54*a*, 54*b*, 56*a*, 56*b* of the ducts 50, 52 also reduces the risk of the sensors 64 becoming dirty and inoperative.

As can be seen from FIG. 2, the shape of the cavity entrance 32 is such that the front edge 32*a* is generally straight and extends laterally across the width of the hand dryer 10. However, the rear edge 32*b* has a shape which consists of two curved portions 33 which generally follow the shape of the backs of a pair of human hands as they are inserted downwardly into the cavity 30 through the cavity entrance 32. The rear edge 32*b* of the cavity entrance 32 is substantially symmetrical about the centre line of the hand dryer 10. The intention of the shaping and dimensioning of the front and rear edges 32*a*, 32*b* of the cavity entrance 32 is that, when a user's hands are inserted into the cavity 30 through the cavity entrance 32, the distance from any point on the user's hands to the nearest slot-like opening is substantially uniform.

Figure 7A:
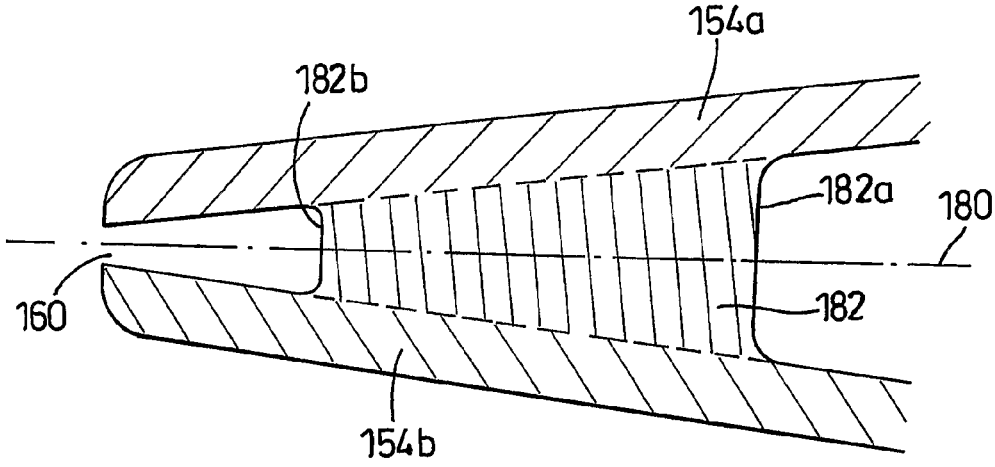
FIG. 7*a* is a schematic sectional side view of an alternative arrangement of a slot-like opening located in the cavity of the hand dryer of FIG. 1.

FIG. 7*a* shows an alternative configuration of one of the slot-like openings illustrated in FIGS. 5 and 6. In this alternative configuration, the slot-like opening 160 is formed between two walls 154*a*, 154*b* which approach one another along an axis 180. The downstream end of each wall 154*a*, 154*b* is shaped so that a sharp corner is formed at the edge which is closest to the slot-like opening 160 but a smoothly curved edge is formed at the edge remote from the slot-like opening 160. The sharp edge reduces turbulence and helps to maintain the velocity of the airflow as it leaves the slot-like opening whilst the curved edge reduces the risk of objects becoming caught on the protruding walls 154*a*, 154*b*.

The walls 154*a*, 154*b* are each inclined to the axis 80 at an angle of 7°, giving an angle between the walls 154*a*, 154*b* of 14°. This has been found to be particularly effective at producing an airflow which maintains a high level of momentum as it leaves the slot-like opening 160. The angle between the walls 154*a*, 154*b* can be varied between 10° and 20° if desired but 14° has been found to be advantageous.

In the arrangement shown in FIG. 7*a*, an upstanding member 82 is located between the walls 154*a*, 154*b*. This upstanding member 182 is arranged to brace the two walls 154*a*, 154*b* apart at precisely the correct distance required for the hand dryer. The upstanding member 182 is moulded integrally with the upper wall 154*a* and is brought into abutment with the lower wall 154*b* during the manufacturing process. The lower wall 154*b* can include special shapings (not shown) against which the upstanding member 182 abuts.

Figure 7B:
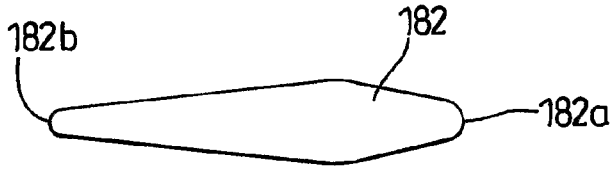
FIGS. 7*b* and 7*c* are plan views of two alternative designs of an upstanding member located in the slot-like opening of FIG. 7*a;*
Figure 7C:
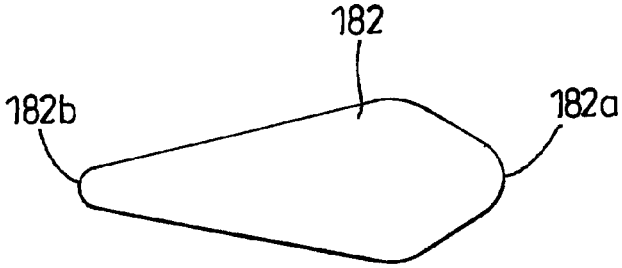

The upstanding member 182 is shaped, in cross-section, as shown in either of FIGS. 7*b* and 7*c*. Essentially, the cross-sectional area of the upstanding member 182 is tear-drop shaped, each side resembling the upper half of an aerofoil. This shape is designed to allow the airflow passing between the walls 154*a*, 154*b* to pass the upstanding members 182 with the minimal amount of turbulence being created in the airflow. Specifically, the upstanding member 182 has a rounded upstream end 182*a* and an elongated downstream end 182*b*. The breadth of the upstanding member 182 can be varied, as can be seen from FIGS. 7*b* and 7*c*.

The upstanding member 182 is shaped so that, at the points where it meets or joins one of the walls 154*a*, 154*b*, a smoothly curved blend is formed (see FIG. 7*a*). This can be achieved during the moulding process. Also, the upstanding member 182 is positioned so that its downstream end 182*b* lies a predetermined distance from the slot-like opening 160. In the embodiment shown, that predetermined distance is substantially 2.5 mm, but this could be varied up to 10 mm.

A plurality of upstanding members 182 can be positioned at intervals along each of the slot-like openings 60, 62 included in the hand dryer 10 described above. The preferred number of upstanding members 182 positioned along each of the slot-like openings 60, 62 is three. Each upstanding member 182 is positioned so that the distance between the downstream end of the upstanding member 182 and the slot-like opening 60, 62 is the same.

The hand dryer 10 described above operates in the following manner. When a user's hands are first inserted into the cavity 30 through the cavity entrance 32, the sensors 64 detect the presence of the user's hands and send a signal to the motor to drive the fan 40. The fan 40 is thus activated and air is drawn into the hand dryer 10 via the air inlet 44 at a rate of approximately 20 to 40 litres per second and preferably at a rate of least 25 to 27 litres per second, more preferably air is drawn into the hand dryer 10 at a rate of 31 to 35 litres per second. The air passes through the filter 46 and along the fan inlet 42 to the fan 40. The airflow leaving the fan 40 is divided into two separate airflows; one passing along the front air duct 50 to the slot-like opening 60 and the other passing along the rear air duct 52 to the slot-like opening 62.

As the airflow meets the upstanding members 182, it divides so as to pass around the upstanding members 182 and subsequently rejoins once it has passed the downstream end of the respective upstanding member 182. The airflow is then ejected from the slot-like openings 60, 62 in the form of very thin, stratified sheets of high velocity, high pressure air. As the airflows leave the slot-like openings 60, 62, the air pressure is at least 15 kPa and preferably approximately 20 to 23 kPa. Furthermore, the speed of the airflow leaving the slot-like openings 60, 62 is at least 80 m/s and preferably at least 100 or 150 m/s, more preferably approximately 180 m/s. Because the size of the slot-like opening 62 located at the end of the rear duct 52 is greater than the size of the slot-like opening 60 located at the end of the front duct 50, a larger volume of air is emitted from the duct 52 than from the duct 50. This provides a greater mass of air for drying the backs of the user's hands which is advantageous.

The two thin sheets of stratified, high velocity, high pressure air are directed towards the surfaces of the user's hands which, during use, are inserted fully into the cavity 30 and are subsequently withdrawn from the cavity 30 via the cavity entrance 32. As the user's hands pass into and out of the cavity 30, the sheets of air blow any existing water off the user's hands. This is achieved reliably and effectively because of the high momentum of the air leaving the slot-like openings 60, 62.

Each stratified sheet of air is directed towards the wall of the cavity 30 which is remote from the slot-like opening through which the respective sheet of air is emitted. Because the slot-like openings 60, 62 are also inclined towards the lowermost end of the cavity 30, the emitted airflows are directed into the cavity 30. This reduces the risk of turbulent air movement being felt by the user outside the casing, eg in the user's face.

It is envisaged that it will take only a small number of "passes" of the hand dryer described above to dry a user's hands to a satisfactory degree. (By "pass", we mean a single insertion of the hands into the cavity and subsequent removal therefrom at a speed which is not unacceptable to an average user. We envisage that a single pass will have a duration of no more than 3 seconds.) The momentum achieved by the airflows is sufficient to remove the majority of water found on the surface of the user's hands after washing during a single pass.

The water removed by the airflows is collected inside the cavity 30. Each airflow will rapidly lose its momentum once it has passed the user's hands and the water droplets will fall to the lower end of the cavity 30 under the forces of gravity whilst the air exits the cavity 30 either through the cavity entrance 32 or via the open sides of the cavity 30. The water, however, is collected by the drain 38 and passed to a reservoir (not shown) where it is collected for disposal. The reservoir can be emptied manually if desired. Alternatively, the hand dryer 10 can incorporate some form of water dispersal system including, for example, a heater for evaporating the collected water into the atmosphere. The means by which the collected water is dispersed does not form part of the present invention.

In an alternative embodiment, the slot-like openings 60, 62 can be arranged so that the sheets of air which are emitted therefrom are directed generally along planes which are substantially parallel to one another. This minimises the amount of turbulent flow present inside the cavity 30 whilst the drying apparatus is in use.

Figures 8A, 8B:
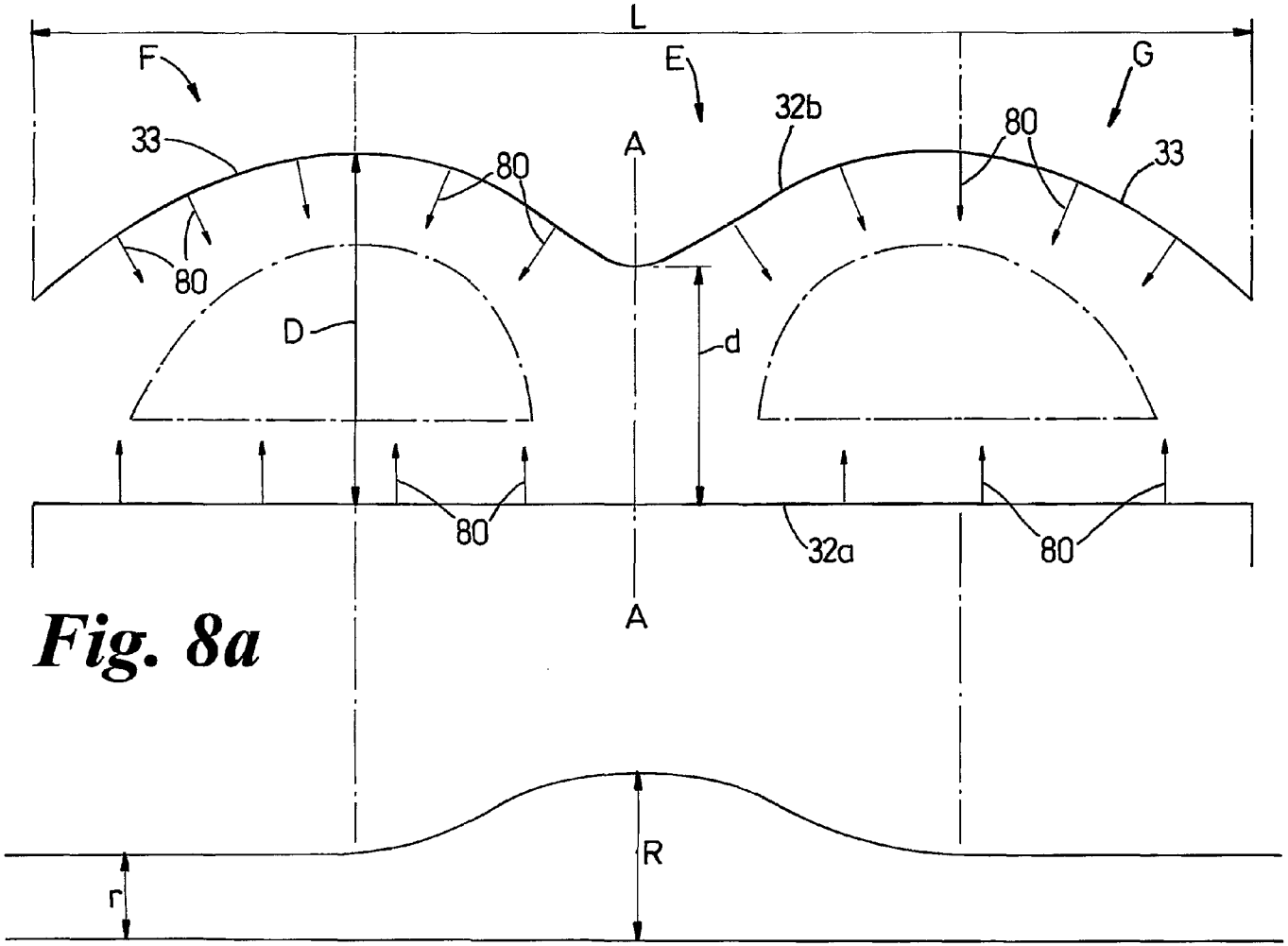
FIG. 8*a* is a plan view of the cavity entrance of a hand dryer according to a second embodiment of the invention.
FIG. 8*b* is a front view of the slot-like opening located in the rear wall of the cavity of the hand dryer of FIG. 8*a*.

In a further alternative embodiment shown in FIGS. 8*a* and 8*b* the slot-like openings are not of constant width across the length L of the cavity of the hand dryer. FIG. 8*a* shows a plan view of the cavity entrance of length L. The dotted lines indicate the position and shape of the user's hands as they are normally inserted into the cavity 30 between the front and rear edges 32*a*, 32*b*. The arrows 80 shown in FIG. 8*a* indicate the direction of the airflow emitted from the slot-like openings 60, 62 located in the edges 32*a*, 32*b* of the cavity entrance 32. In this embodiment the curved portions 33 of the rear edge 32*b* are symmetrical about the centre line A-A of the cavity entrance 32 with the centre portion of the rear edge 32*b* being closer to the front edge 32*a* at the centre line than at a position spaced from the centre line. The minimum distance d between the front and rear edges 32*a*, 32*b* is at the centre line. The distance between the front edge 32*a* and the rear edge 32*b* is at a maximum, D, at the mid point of each curved portion. FIG. 8*b* shows the shape of the slot-like opening located in the rear wall of the cavity.

Preferably, the width of the slot-like opening in the rear wall varies gradually, increasing towards the mid point of the opening, at centre line A-A of cavity entrance 32.

In this alternative embodiment it is preferred that the variation in width of the opening is achieved by varying the distance of the upper wall of the slot-like opening away from the lower wall, in the shape of a curve, preferably in a smoothly curving shape. More preferably the curve is symmetrical about centre line A-A of the cavity entrance 32. Preferably the maximum width R of the opening is at centre line A-A and is 0.7 mm.

Preferably, the width r is substantially constant in regions F and G with the varying width region (region E in FIGS. 8*a* and 8*b*) comprising at least half the total length L of the cavity entrance, most preferably the central half. Preferably r is 0.4 mm.

In region E of the hand dryer the width of the slot-like opening 62 is greater than the width of the slot-like opening 62 in regions F and G. The increase in size of the slot-like opening 62 provides a greater mass of air 80 from rear duct 52 for drying the backs of the user's hands in the thumb and forefinger area which is advantageous. The greater mass of air in region E and the momentum achieved by the airflow is sufficient to remove the majority of water found on the backs of the user's hands after washing during a single pass.

Because of the fact that the walls of the slot-like openings 60, 62 are able to be moulded by compression moulding of a thermosetting plastics material such as melamine, the manufacturing costs of the hand dryer are reduced in comparison to known apparatus. The presence of the upstanding members allows the width of the slot-like openings to be maintained at a constant value which ensures that the airflows emitted from the slot-like openings are substantially even along their length.

The invention is not intended to be limited to the precise detail of the embodiment described above. Modifications and variations to the detail which do not alter the scope of the invention will be apparent to a skilled reader. For example, the shape of the slot-like openings described above can be altered if desired. Also, the means by which the water removed from the user's hands is disposed of may be altered without departing from the essence of the present invention.

The invention claimed is:

1. A hand drying apparatus, comprising:

a front portion having an upper end, the front portion comprising, proximate to the upper end, a slot-like opening formed between opposing slot walls, wherein the opposing slot walls are manufactured from a thermosetting plastics material, and at least one upstanding member is provided between the opposing slot walls;

a rear portion having an upper end, the rear portion comprising, proximate to the upper end, a slot-like opening formed between opposing slot walls, wherein the opposing slot walls are manufactured from a thermosetting plastics material, and at least one upstanding member is provided between the opposing slot walls;

a cavity formed between the front portion and the rear portion, wherein the upper end of the front portion and the upper end of the rear portion are spaced apart to provide an opening into the cavity through which a user's hands may be inserted; and a fan, wherein the slot-like opening in the front portion is in communication with the fan so as to direct a portion of an airflow generated by the fan transversely across the opening of the cavity in a first direction, and the slot-like opening in the rear portion is in communication with the fan so as to direct a portion of the airflow generated by the fan transversely across the opening of the cavity in a second direction, different from the first direction.

2. The hand drying apparatus as claimed in claim 1, wherein the front portion and the rear portion are formed from melamine.

3. The hand drying apparatus as claimed in claim 1, wherein each of the slot-like openings has a maximum width which is no greater than 0.5 mm.

4. The hand drying apparatus as claimed in claim 3, wherein the width of each of the slot-like openings is at least 0.3 mm.

5. The hand drying apparatus as claimed in claim 4, wherein the width of each of the slot-like openings is no more than 0.4 mm.

6. The hand drying apparatus as claimed in claim 1, wherein each of the slot-like openings has a constant width along its length.

7. The hand drying apparatus as claimed in claim 1, wherein the at least one upstanding member is formed integrally with one of the opposing slot walls.

8. The hand drying apparatus as claimed in claim 1, wherein the at least one upstanding member is shaped so as to minimise the introduction of turbulence to an airstream emitted through the slot-like opening when the hand drying apparatus is in use.

9. The hand drying apparatus as claimed in claim 8, wherein the at least one upstanding member has a tear-drop shaped cross-sectional shape.

10. The hand drying apparatus as claimed in claim 1, wherein at least one upstanding member is positioned a predetermined distance from at least one of the slot-like openings.

11. The hand drying apparatus as claimed in claim 10, wherein at least one upstanding member is positioned no more than 10mm from at least one of the slot-like openings.

12. The hand drying apparatus as claimed in claim 11, wherein at least one upstanding member is positioned substantially 2.5mm from at least one of the slot-like openings.

13. The hand drying apparatus as claimed in claim 1, wherein the thermosetting plastics material has antibacterial properties.

* * * * *